US007476819B1

(12) United States Patent
Steele et al.

(10) Patent No.: US 7,476,819 B1
(45) Date of Patent: Jan. 13, 2009

(54) SWITCH BOX FOR MULTI-DIRECTIONAL ACTIVATION OF A RIBBON SWITCH

(75) Inventors: Michael J. Steele, Port Jefferson Station, NY (US); John E. Gavey, West Babylon, NY (US)

(73) Assignee: Tapeswitch Corporation, Farmingdale, NY (US)

( * ) Notice: Subject to any disclaimer, the term of this patent is extended or adjusted under 35 U.S.C. 154(b) by 0 days.

(21) Appl. No.: 12/019,544

(22) Filed: Jan. 24, 2008

Related U.S. Application Data

(60) Provisional application No. 60/886,547, filed on Jan. 25, 2007.

(51) Int. Cl.
*H01H 3/16* (2006.01)

(52) U.S. Cl. ..... 200/61.42; 200/61.43; 200/61.44; 200/512

(58) Field of Classification Search ... 200/61.41–61.44, 200/61.71, 61.73, 85 R, 86 R, 86 A, 85 A, 200/511, 512; 49/26–28
See application file for complete search history.

(56) References Cited

U.S. PATENT DOCUMENTS

| | | | | |
|---|---|---|---|---|
| 4,532,388 | A * | 7/1985 | Sackmann et al. | 200/61.43 |
| 4,684,768 | A * | 8/1987 | Sackmann et al. | 200/61.43 |
| 6,534,731 | B1 * | 3/2003 | Beckhausen et al. | 200/61.43 |
| 6,740,826 | B1 * | 5/2004 | Friedrich et al. | 200/61.43 |
| 7,102,089 | B2 * | 9/2006 | Burgess et al. | 200/61.43 |
| 7,342,190 | B2 * | 3/2008 | Burgess et al. | 200/61.43 |

* cited by examiner

*Primary Examiner*—Michael A Friedhofer
(74) *Attorney, Agent, or Firm*—Philip O. Post

(57) ABSTRACT

A switch box is provided for converting a unidirectionally activated ribbon switch inserted in the switch box into a multi-directionally activated ribbon switch. At least two pairs of fingers protruding from the body of the switch box contact one or more posts protruding into the hollow interior of an external housing in which the switch box is inserted so that external compression of the housing forces the posts into the fingers and the external body of the switch box to activate the unidirectional ribbon switch.

12 Claims, 5 Drawing Sheets

SWITCH BOX FOR MULTI-DIRECTIONAL ACTIVATION OF A RIBBON SWITCH

CROSS REFERENCE TO RELATED APPLICATIONS

This application claims the benefit of U.S. Provisional Application No. 60/886,547, filed Jan. 25, 2007, hereby incorporated by reference in its entirety.

FIELD OF THE INVENTION

The present invention relates to a switch box for use with a unidirectionally activated ribbon switch to convert the unidirectionally activated ribbon switch into a multi-directionally activated switch.

BACKGROUND OF THE INVENTION

A typical ribbon switch 101 is illustrated in isometric cross section in FIG. 1(*a*). The switch has a bead 101*a* protruding from a substantially rectangular shaped switch body that encloses at least two thin film electrical conductors 101*b* and 101*c* that are electrically isolated from each other in the normal state as diagrammatically shown in FIG. 1(*b*). The two ribbon switch conductors can be connected to an external electrical circuit at one end of the ribbon, for example, by external conductors 102*a* and 102*b*. When external pressure is applied to the switch, typically over the bead as illustrated by the arrow in FIG. 1(*c*), the ribbon switch compresses to force the two ribbon switch conductors together at the point of compression. To an external electric circuit connected to conductors 102*a* and 102*b*, the ribbon switch is effectively used as a normally open set of contacts (FIG. 1(*b*)) that transition to a closed set of contacts (FIG. 1(*c*)) when external pressure is applied to the switch for switch circuit activation. A limitation of this type of ribbon switch is that the effective operating direction of the switch is limited to an external force applied to the surface of the ribbon switch with the bead as shown in FIG. 1(*c*).

One object of the present invention is to extend the effective operating direction of a typical unidirectional ribbon switch so that the switch can be activated from multiple directions without modification of the unidirectional ribbon switch.

BRIEF SUMMARY OF THE INVENTION

In one aspect the present invention is a switch box for converting a unidirectionally activated ribbon switch inserted in the switch box into a multi-directionally activated ribbon switch. The exterior body of the switch box and fingers protruding from the body of the switch box contact one or more posts protruding into the hollow interior of a housing in which the switch box can be inserted so that external compression of the housing forces the posts into the body or fingers of the switch box to activate the unidirectionally activated ribbon switch inserted in the switchbox.

These and other aspects of the invention are set forth in this specification and the appended claims.

BRIEF DESCRIPTION OF THE DRAWINGS

The foregoing brief summary, as well as the following detailed description of the invention, is better understood when read in conjunction with the appended drawings. For the purpose of illustrating the invention, there is shown in the drawings exemplary forms of the invention that are presently preferred; however, the invention is not limited to the specific arrangements and instrumentalities disclosed in the following appended drawings.

DETAILED DESCRIPTION OF THE INVENTION

Figure 1A:
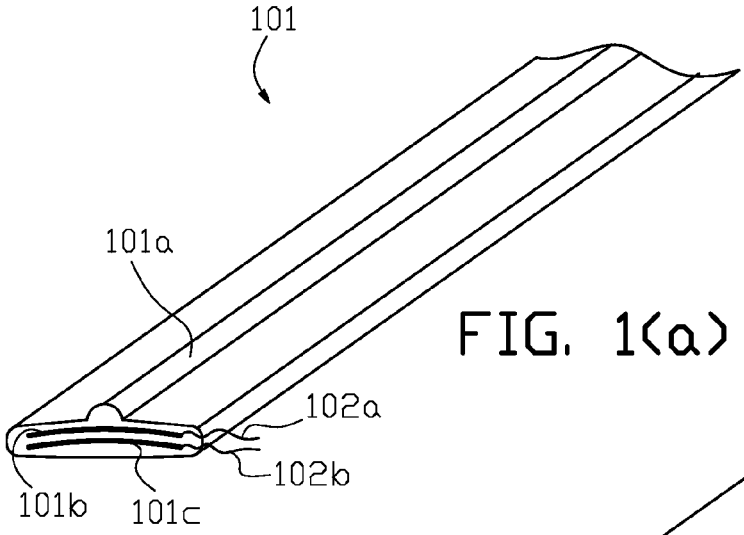
FIG. 1(*a*), FIG. 1(*b*) and FIG. 1(*c*) illustrate a typical unidirectionally activated ribbon switch.
Figure 1B:
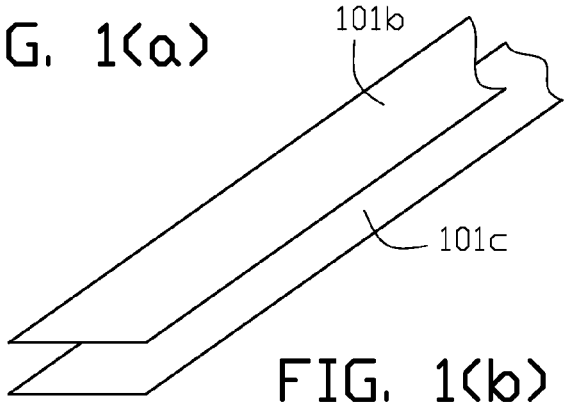
Figure 1C:
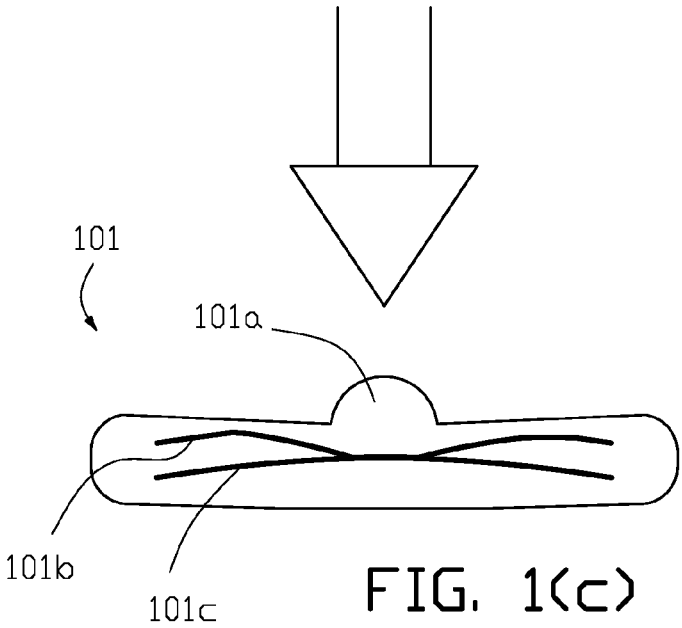
FIG. 1(c) PRIOR ART
Figure 2A:
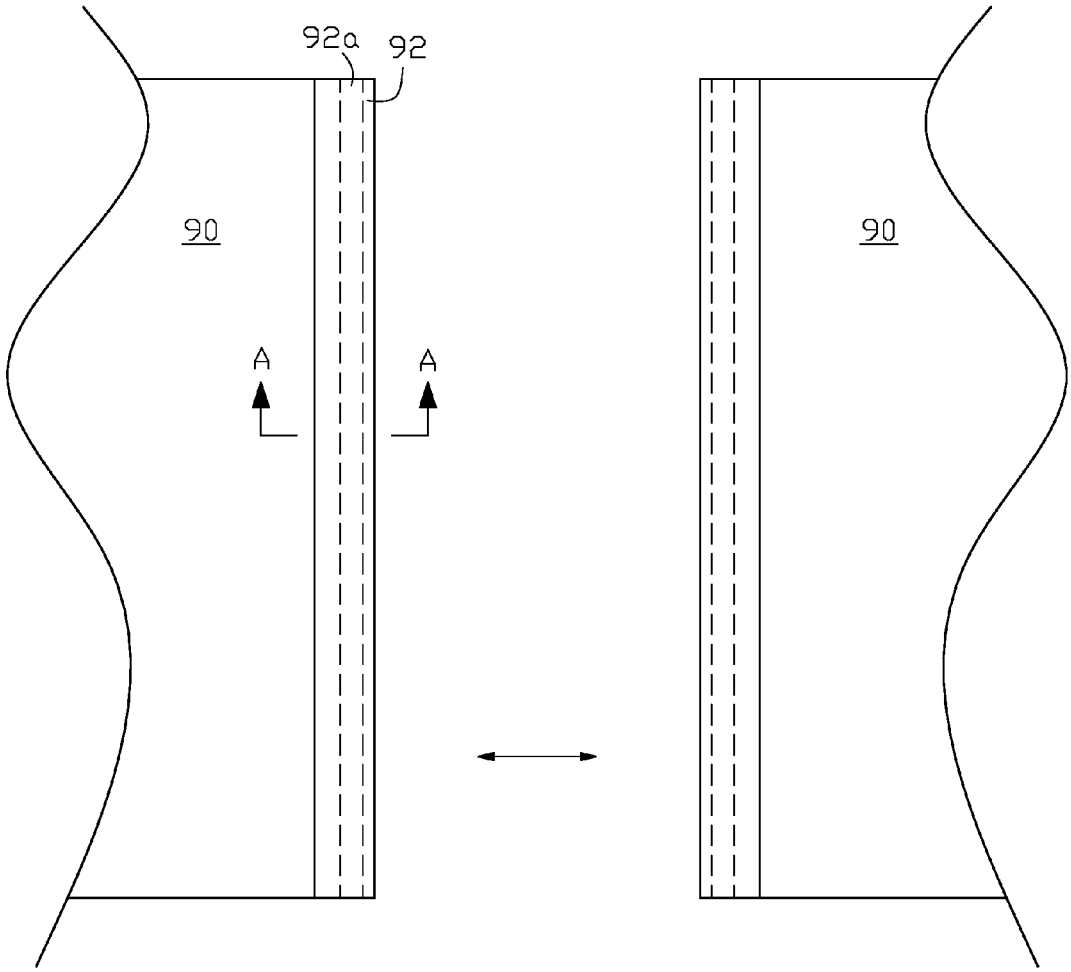
FIG. 2(*a*) and FIG. 2(*b*) (cross section through line A-A in FIG. 2(*a*)) illustrate a typical application for the switch box of the present invention.
Figure 2B:
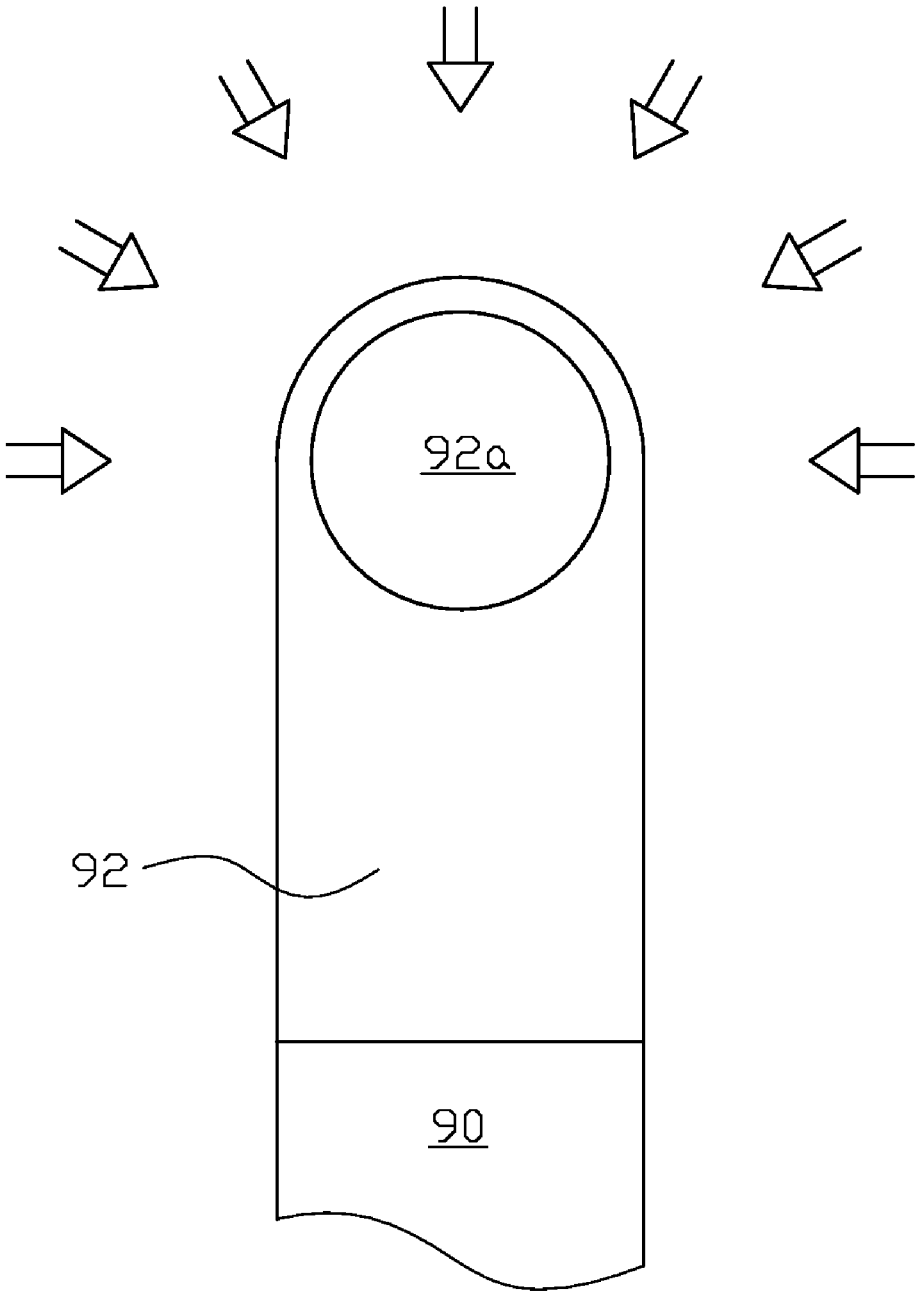

FIG. 2(*a*) illustrates one non-limiting application of the switch box for multi-directionally activation of a ribbon switch. Element 90 represents a pair of opposing structural elements, such as doors that move towards, or away from, each other in the directions of the double headed arrow shown in FIG. 2(*a*). At the edge of each door 90 is a flexible edge housing 92 that, in this example, runs the height of the door. In other applications the flexible edge housing may be applied only partially along the length of the edges, or may be applied to only one of the two structural elements.

Edge housing 92 is shown in cross section in FIG. 2(*b*). Edge housing 92 has a generally cylindrical interior opening 92*a* running through the length of the edge housing.

In this example of the invention, switch box 10 is inserted into the generally cylindrical interior opening of edge housing 92 to enable ribbon switch 101, which is inserted into the switchbox, to be activated by an external force applied to the edge housing anywhere through a maximum arced region of approximately 180 degrees as illustrated by the arrows in FIG. 2(*b*). One type of suitable unidirectionally ribbon switch is Model No. 161-FS available from TAPESWITCH CORP (Farmingdale, N.Y.).

Figure 3:
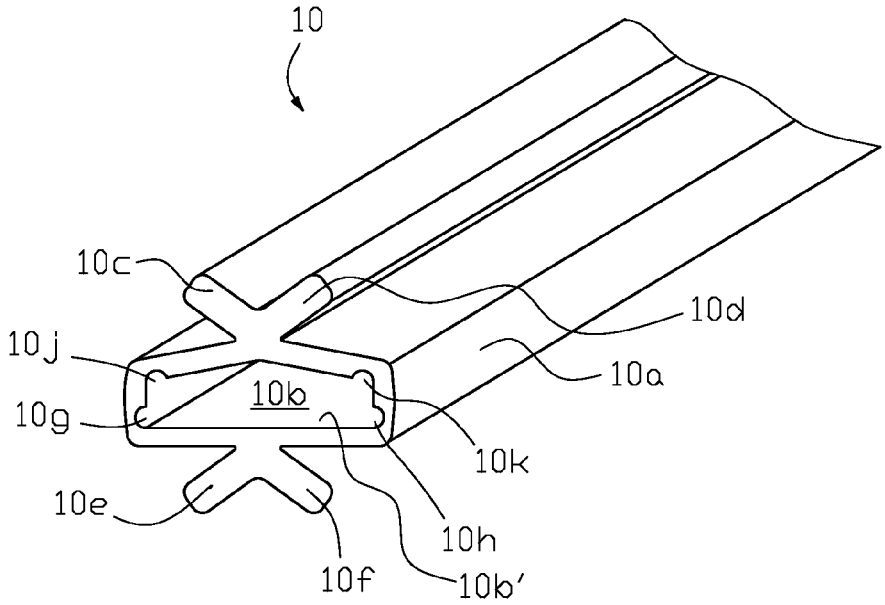
FIG. 3 is a cross sectional isometric illustration of one example of a switch box of the present invention.
Figure 4:
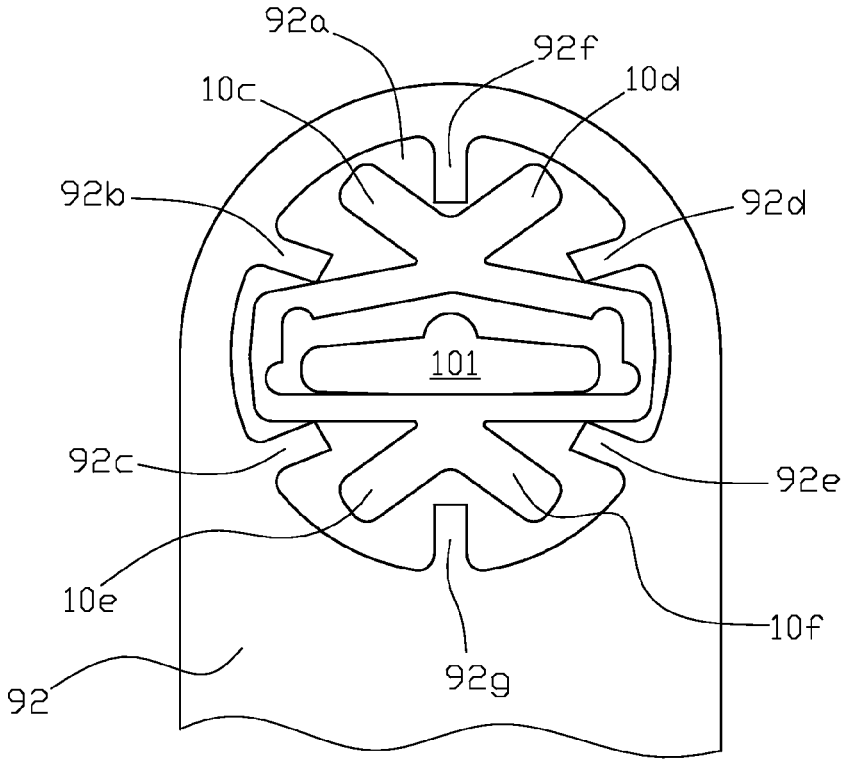
FIG. 4 is a cross sectional illustration of the switch box shown in FIG. 3 inserted into an edge housing with multiple internal posts.
Figure 5:
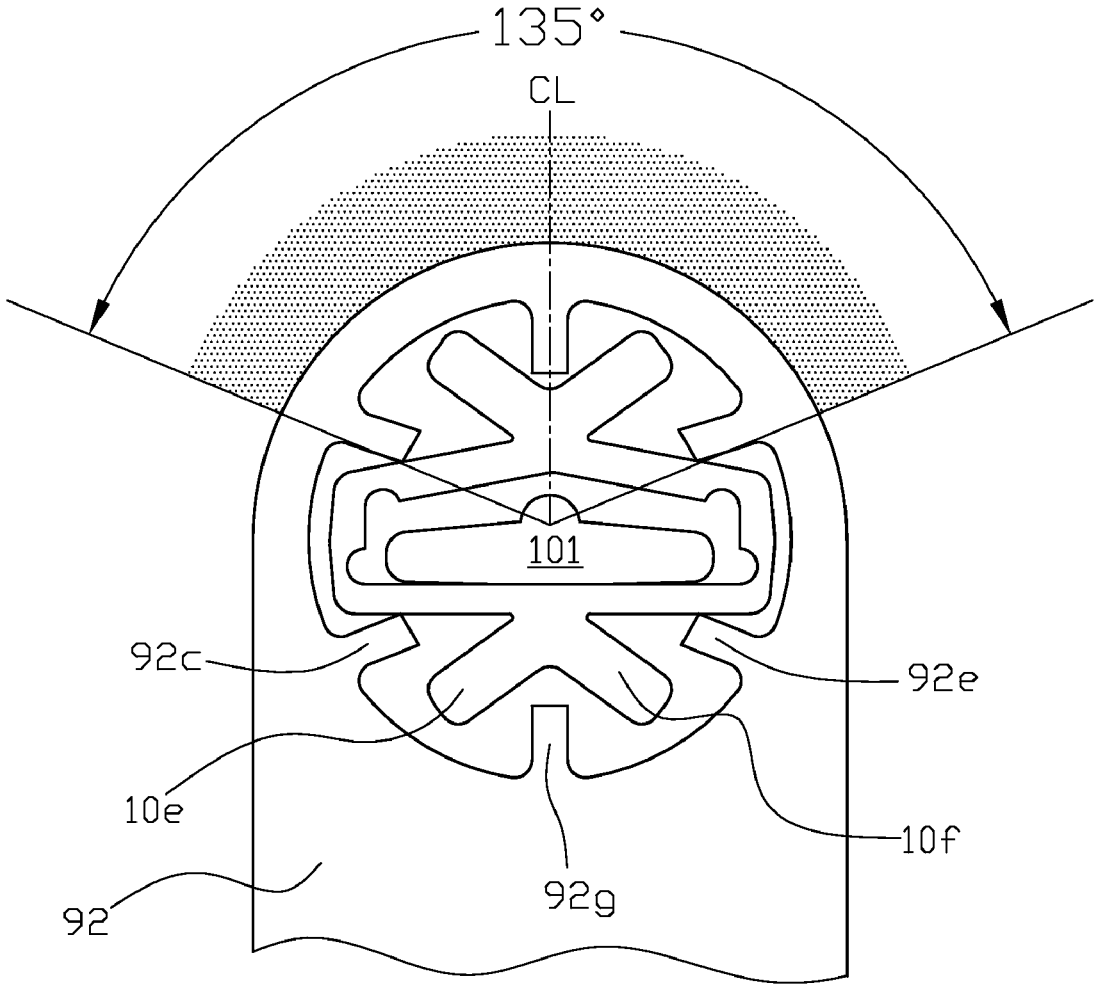
FIG. 5 illustrates a typical arced region in which the ribbon switch shown in FIG. 4 can be activated by application of an external compressive force in the arced region.

One example of switch box 10 of the present invention is illustrated in isometric cross section in FIG. 3. The switch box is inserted into edge housing 92 as shown in FIG. 4. Opening 92*a* in edge housing 92 is modified by providing interior opposing pairs of horizontal side posts, 92*b*-92*c* and 92*d*-92*e*, and opposing vertical top and bottom posts, 92*f* and 92*g*, respectively, as shown in FIG. 4.

Switch box 10 comprises a generally rectangular body 10*a* with hollow interior 10*b* and the side facing bead 101*a* of ribbon switch 101 sloped away from the bead. A pair of switch box fingers, 10*c*-10*d* and 10*e*-10*f*, originate on opposing exterior sides of rectangular body 10*a*. Each pair of fingers is spread apart to form a "V" region into which top and bottom posts of edge housing are fitted. A suitable, but non-limiting, internal angle between the pair of fingers is approximately 108 degrees. The ends of rectangular body 10*a* are positioned between the opposing pairs of horizontal posts as shown in the figures. The switch box is composed of a suitable elastic material, such as a thermoplastic elastomer, so that when an external force is applied to the edge housing anywhere in the region identified by the arrows in FIG. 2(*b*), one or more of the edge housing's posts will compress the switch box sufficiently so that ribbon switch 101 contained within the switch box will activate by forcing conductors 101*b* and 101*c* to make contact with each other somewhere along the length of unidirectional ribbon switch 101 that is inserted in the switch box. Ribbon switch 101 can be suitably attached to the lower interior wall 10*b*' of switch box 10 to hold the ribbon switch in place as shown in FIG. 4.

Optionally generally semicircular interior bottom edge corner cutouts 10*g* and 10*h*, and/or generally semicircular top edge corner cutouts 10*j* and 10*k* can be provided to allow increased flexing of the switch box when the external force compresses one or more of the edge housing posts.

FIG. (5) illustrates a minimum arced region of 135 degrees about centerline CL in which an external compressive force applied to the flexible edge housing can compress the elastic switch box 10 so that switch 101 will activated by forcing conductors 101*b* and 101*c* to make contact with each other somewhere along the length of the unidirectional ribbon switch.

The above examples of the invention have been provided merely for the purpose of explanation, and are in no way to be construed as limiting of the present invention. While the invention has been described with reference to various embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses. Those skilled in the art, having the benefit of the teachings of this specification, may effect numerous modifications thereto, and changes may be made without departing from the scope and spirit of the invention in its aspects.

The invention claimed is:

1. A switch box formed from at least partially from an elastic material for converting a substantially unidirectionally activated ribbon switch inserted into the switch box into a multi-directionally activated ribbon switch, the switch box comprising a generally rectangularly shaped longitudinal body having a hollow interior; and a pair of switch box fingers extending from each one of two opposing exterior sides of the rectangularly shaped longitudinal body to form a V-shaped region above each one of the two opposing exterior sides, whereby applying an external compression force to the switch box anywhere within an arced region will activate a substantially unidirectionally activated ribbon switch inserted into the switch box.

2. The switch box of claim 1 wherein one of the two opposing interior sides of the switch box is configured to accommodate a bead on a substantially unidirectionally activated ribbon switch inserted into the switch box to prevent activation of the unidirectionally ribbon switch unless the external compression force is applied.

3. The switch box of claim 1 further comprising edge cutouts in one or more of the corners of the hollow interior of the switch box.

4. A multi-directionally activated switch assembly comprising:

an at least partially elastic switch box comprising a generally rectangularly shaped longitudinal body having a hollow interior and a pair of switch box fingers extending from each one of two opposing exterior sides of the rectangularly shaped longitudinal body to form a V-shaped region above each one of the two opposing exterior sides of the switch; and a substantially unidirectionally activated ribbon switch disposed with the hollow interior of the switch box whereby applying an external compressive force to the switch box anywhere within an arced region will activate the unidirectional ribbon switch.

5. The multi-directionally activated switch assembly of claim 4 wherein one of the two opposing interior sides of the switch box is configured to accommodate a bead on the substantially unidirectionally activated ribbon switch to prevent activation of the ribbon switch unless the external compressive force is applied.

6. The multi-directionally activated switch assembly of claim 4 further comprising edge cutouts in one or more of the corners of the hollow interior of the switch box.

7. An external compressive force activated edge switch assembly installed on at least one of a pair of opposing longitudinal edges of structural elements adjustably arranged to bring the opposing longitudinal edges adjacent to each other, the edge switch assembly comprising:

a flexible edge housing attached to at least one of the pair of opposing longitudinal edges at least partially along the length of the edge, the edge housing having an edge housing internal longitudinal opening running at least partially along the length of the edge housing, the edge housing internal longitudinal opening having at least one post protruding into the interior of the edge housing internal longitudinal opening at least partially along the length of the flexible edge housing;

an at least partially elastic switch box disposed in the edge housing internal longitudinal opening, the switch box having a switch box internal longitudinal opening running along the length of the switch box, the switch box internal longitudinal opening generally rectangularly shaped in cross section, the switch box having at least one external surface located adjacent to the at least one post; and a substantially unidirectionally activated ribbon switch disposed within the switch box internal longitudinal opening so that an external compressive force applied anywhere over an arced region to the exterior of the flexible edge housing will activate the substantially unidirectionally activated ribbon switch.

8. The external compressive force activated edge switch assembly of claim 7 wherein one of the two opposing interior sides of the switch box is configured to accommodate a bead on the substantially unidirectionally activated ribbon switch to prevent activation of the ribbon switch unless the external compressive force is applied.

9. The external compressive force activated edge switch assembly of claim 7 further comprising edge cutouts in one or more of the corners of the internal longitudinal opening of the switch box.

10. The external compressive force activated edge switch assembly of claim 7 wherein the switch box has a pair of switch box fingers extending from each one of two opposing exterior sides of the switch box to form a V-shaped region above each one of the two opposing exterior sides, one of the at least one posts protruding into the interior of each one of the V-shaped regions formed by the pair of switch box fingers.

11. The external compressive force activated edge switch assembly of claim 10 wherein a pair of the at least one posts are disposed adjacent to each end of the switch box formed by the two opposing exterior sides.

12. The external compressive force activated edge switch assembly of claim 7 wherein the arced region of activation is at least 135 degrees around a centerline of the edge housing.

* * * * *